United States Patent [19]

Berendt et al.

[11] Patent Number: 4,792,619

[45] Date of Patent: Dec. 20, 1988

[54] PROCESS FOR PRINTING OR DYEING CELLULOSE-CONTAINING TEXTILE MATERIAL: NOVEL QUATERNARY AMMONIUM SALT FROM SULPHO-SUCCINIC ACID MIXED: DI-ESTER FOR DYE FOAM STABILITY

[75] Inventors: Hans-Ulrich Berendt, Allschwil; Martin Kuhn, Dornach, both of Switzerland

[73] Assignee: Ciba-Geigy Corporation, Ardsley, N.Y.

[21] Appl. No.: 158,974

[22] Filed: Feb. 22, 1988

Related U.S. Application Data

[62] Division of Ser. No. 46,971, May 6, 1987, Pat. No. 4,741,739.

[30] Foreign Application Priority Data

May 16, 1986 [CH] Switzerland ..... 1989/86

[51] Int. Cl.[4] ..... C07C 149/20; C07C 143/90; C11D 1/28

[52] U.S. Cl. ..... 560/151; 8/477; 260/401; 260/513 N; 558/445

[58] Field of Search ..... 260/401; 560/151; 558/445

[56] References Cited

U.S. PATENT DOCUMENTS

| | | | |
|---|---|---|---|
| 4,001,285 | 1/1977 | Hochreuter | 260/401 |
| 4,051,158 | 9/1977 | Samour et al. | 260/401 |
| 4,741,739 | 5/1988 | Berendt et al. | 8/477 |

*Primary Examiner*—A. Lionel Clingman
*Attorney, Agent, or Firm*—Kevin T. Mansfield; Edward McC. Roberts

[57] ABSTRACT

Textile cellulose material is printed or dyed with reactive dyes with the aid of foam. The foam is applied by applying to the cellulose material a foamed, aqueous preparation which contains in addition to dyes and fixing alkalis (1) a foam-forming agent (2) a homopolymer or copolymer of acrylamide or methacrylamide or preferably a graft polymer which is obtained from an addition product of an alkylene oxide, preferably propylene oxide, on an at least trihydric aliphatic alcohol, e.g. glycerol, and acrylamide or methacrylamide, and (3) a betainelike quaternary ammonium salt which is obtainable by condensation of (A) a sulfonated asymmetric succinic acid diester which has as ester groups a halohydrin group and an etherified polyalkylene glycol group, with (B) a tertiary amine-substituted N-alkylamide of ethylenically unsaturated aliphatic monocarboxylic or dicarboxylic acid.

The cellulose material thus treated is then subjected to a heat treatment, for example steaming, to fix the dye.

This very stable preparation produces without the use of thickenings, in particular alginates, a strong, level and crisp print which at the same time has an excellent handle.

6 Claims, No Drawings

PROCESS FOR PRINTING OR DYEING CELLULOSE-CONTAINING TEXTILE MATERIAL: NOVEL QUATERNARY AMMONIUM SALT FROM SULPHO-SUCCINIC ACID MIXED: DI-ESTER FOR DYE FOAM STABILITY

This is a divisional of application Ser. No. 046,971 filed on May 6, 1987 now U.S. Pat. No. 4,741,739.

The present invention relates to a process for printing or dyeing cellulose-containing textile material with reactive dyes and with the aid of foam.

It is known that cellulose fibre materials can be dyed with the aid of foamed print paste compositions. The colour components used therein are pigments or pigment preparations which are always combined with binders. These binder-containing compositions have the disadvantage that they impair handle.

In printing with reactive dyes, on the other hand, generally no binders are used. For that reason the handle is not affected. However, to obtain adequate crispness with reactive dyes it is necessary to use large amounts of thickeners, in particular alginates. The disadvantage of using alginates is that, after the printing step and fixation of the dye, they must be washed off again. This subsequent wash requires appreciable outlay on machinery and increases the consumption of energy, water and various chemicals.

EP-A-No. 151,091 or U.S. Pat. No. 4,604,099 proposes a foam print paste which is used without thickeners and produces excellent crispness. This foam print paste, which in addition to the dye and the foaming agent contains homopolymers, copolymers or graft polymers based on acrylamide or methacrylamide, generally has sufficient foam stability. However, owing to certain dye formulations, high shearing forces and long residence times in the application unit, the foam stability is insufficient in some cases.

It has now been found that the foam stability can be significantly improved by printing or dyeing cellulose-containing textile material using the process described hereinafter.

The present invention accordingly provides a process for printing or dyeing cellulose-containing textile material with reactive dyes by printing or dyeing the textile material with a foamed, aqueous preparation and fixing the dyes through the action of heat, the preparation containing reactive dyes, foaming agents, fixing alkalis, homopolymers or copolymers of acrylamide or methacrylamide or graft polymers which are obtainable from an addition product of an alkylene oxide onto an at least trihydric aliphatic alcohol having 3 to 10 carbon atoms and acrylamide or methacrylamide, wherein the preparation additionally contains a quaternary ammonium salt obtained by condensation of (A) a sulfonated asymmetric succinic acid diester which has as ester groups a halohydrin group and an etherified polyalkylene glycol group, with (B) a tertiary amine-substituted N-alkylamide of ethylenically unsaturated aliphatic monocarboxylic or dicarboxylic acid.

The condensation of components (A) and (B) is advantageously effected at a temperature of 50° to 100° C., and in some instances spontaneous polymerization can occur.

The succinic acid diester (A) is prepared by reacting maleic acid or maleic anhydride first with a monoetherified polyalkylene glycol and then condensing with an epihalohydrin, for example epibromohydrin, β-methylepichlorohydrin or preferably epichlorohydrin, to give the mixed ester. Then the malonic acid diester is sulfited with alkali metal disulfites, alkali metal pyrosulfites or alkali metal hydrogensulfites to give the sulfosuccinate.

The monoesterification of maleic acid is advantageously carried out with monoetherified diols of the formula $$HO-(CH_2CH_2O)_mR \quad (1)$$

in which R is the radical of an aliphatic monoalcohol having 4 to 24 carbon atoms, preferably 8 to 22 carbon atoms, and m is 4 to 120, preferably 8 to 60.

The monoalcohol radicals can be straight-chain or branched. They are derived for example from butanols, amyl alcohols, neopentyl alcohol, hexanol, 2-ethylbutanol, 2methylpentanol, 2-ethyl-hexanol, heptanol, 5-methylheptan-3-ol, octan-2-ol, capryl alcohol, trimethylnonyl alcohol, decanol, lauryl alcohol, myristyl alcohol, cetyl alcohol, palmityl alcohol, stearyl alcohol, arachidyl alcohol or behenyl alcohol.

Also suitable are unsaturated aliphatic monoalcohols, for example crotyl alcohol, dodecenyl alcohol, hexadecenyl alcohol or oleyl alcohol.

The monoalcohols can be used individually or as mixtures.

R in the formula (1) is preferably alkyl having 12 to 22 carbon atoms.

Before etherification the polyethylene glycols required for the purposes of esterification preferably have an average molecular weight of 350 to 2600, in particular 660 to 2300.

Suitable tertiary amine-substituted N-alkylamides for use as component (B) in the preparation of the quaternary ammonium salts advantageously conform to the formula

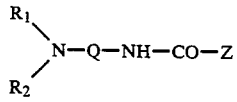

(2)

in which $R_1$ and $R_2$ are each an alkyl radical having 1 to 5 carbon atoms, for example methyl, ethyl, propyl, isopropyl, n-butyl, isobutyl, sec.-butyl, n-amyl or isoamyl, Q is ethylene or preferably propylene and Z—CO— is the acid radical of an ethylenically unsaturated aliphatic monocarboxylic or dicarboxylic acid having at most 10 carbon atoms.

The ethylenically unsaturated monocarboxylic acids are for example acrylic acid, methacrylic acid, α-haloacrylic acid, 2-hydroxyethylacrylic acid, 2-cyanoacrylic acid, crotonic acid, vinylacetic acid, vinylpropionic acid, allylacetic acid or allylhydroxypropionic acid.

Ethylenically unsaturated dicarboxylic acids are preferably fumaric acid, maleic acid or itaconic acid, as well as mesaconic acid, citraconic acid, glutaconic acid or methylenemalonic acid.

Particularly preferred components (B) conform to the formula

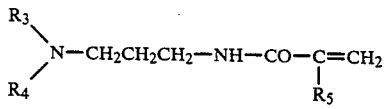

(3)

in which $R_3$ and $R_4$ are each methyl, ethyl or propyl and $R_5$ is hydrogen or methyl.

Component (B) can be prepared in a conventional manner by reacting an N,N-disubstituted alkylenediamine with a halide of an ethylenically unsaturated aliphatic monocarboxylic or dicarboxylic acid, for example with acryloyl chloride or methacryloyl chloride.

The dosage levels in which such quaternary ammonium salts are added alone or mixed to the preparations to be foamed can vary with the printing or dyeing process from 1 to 30 g/l in the form of 10 to 25% aqueous solutions. For instance amounts of 3 to 15 g in the form of 20% aqueous solutions per litre of unfoamed preparation have advantageous utility.

The acrylamide- or methacrylamide-based polymers used according to the invention are preferably the acrylamide graft polymers of the type defined.

Preference is given to graft polymers which are obtainable by graft polymerization of methacrylamide or in particular acrylamide on an adduct of 4 to 100 moles, preferably 40 to 80 moles, of propylene oxide onto trihydric to hexahydric alkanols having 3 to 6 carbon atoms. These alkanols can be straight-chain or branched. Examples are glycerol, trimethylolethane, trimethylolpropane, erythritol, pentaerythritol, mannitol or sorbitol.

Further suitable graft polymers are those which are prepared by grafting methacrylamide or acrylamide onto adducts of mixtures of ethylene oxide and propylene oxide or of ethylene oxide alone onto the polyhydric alcohols mentioned.

Particularly suitable graft polymers are in particular those of acrylamide and products of addition of 40 to 80 moles of propylene oxide onto 1 mole of glycerol.

The graft polymers used according to the invention advantageously contain 2.5 to 50% by weight of the defined addition product as main chain and 50 to 97.5% by weight of grafted-on methacrylamide or preferably acrylamide as side chains.

Preferably the graft polymers have 2.5 to 30% by weight of the alkylene oxide adduct of the type defined and 70 to 97.5% by weight of grafted-on methacrylamide or in particular acrylamide. More preferably, the amide content is 80 to 97.5% by weight, based on the graft polymer.

Of these products, those which contain as main chain 4 to 20% by weight of the product of addition of 40 to 80 moles of propylene oxide onto 1 mole of glycerol and 80 to 96% by weight of acrylamide are particularly preferred.

The stated percentages are based on the graft polymer as a whole.

The preparation of the acrylamide graft polymers used according to the invention is effected in a conventional manner, advantageously by polymerizing (1) a product of addition of an alkylene oxide onto an at least trihydric aliphatic alcohol of 3 to 10 carbon atoms with (2) acrylamide or methacrylamide and in the presence of catalysts, advantageously at a temperature of 40° to 100° C. The products obtained in this way are predominantly graft polymers in which the alkylene oxide adduct forms the main chain, which contains, on individual carbon atoms, the grafted-on acrylamide or methacrylamide in the form of side chains. Details concerning the preparation of the acrylamide graft polymers are described, for example, in European Patent Publication No. 151,091 or in U.S. Pat. No. 4,494,956.

The dosage levels in which the acrylamide polymers required are added alone or mixed to the preparations to be foamed can vary with the printing or dyeing method from 0.5 to 30 g/l in the form of aqueous solutions. For instance, amounts having advantageous utility range from 0.5 to 20 g, advantageously from 0.5 to 10 g preferably from 1 to 5 g, in the form of 2 to 10% aqueous solutions per litre of unfoamed preparation.

Application by foam is possible not only with the acrylamide graft polymers mentioned but also with linear or branched polymers of acrylamide or methacrylamide and copolymers of acrylamide or methacrylamide and further ethylenically unsaturated monomers, e.g. acrylic acid, methacrylic acid, α-haloacrylic acid, 2-hydroxyethylacrylic acid, α-cyanoacrylic acid, crotonic acid, vinylacetic acid, maleic acid, acrylonitrile, methacrylonitrile, vinyl alkyl ether (methyl vinyl ether, isopropyl vinyl ether), vinyl ester (vinyl acetate), styrene, vinyltoluene, vinylsulfonic acid, 2-acrylamido-2-methylpropanesulfonic acid or esters of said α,β-unsaturated carboxylic acids and in particular half-esters of maleic acid with products of addition of 2 to 15 moles of ethylene oxide onto monoalcohols having 8 to 22 carbon atoms. The weight ratio of the acrylamide to the other monomers preferably ranges from 9:1 to 1:1.

Suitable foam-forming agents are in general anionic or nonionic compounds having surface-active properties, which are referred to hereinafter as surfactants. Surfactants reduce the surface tension of solutions, thereby facilitating and stabilizing foam formation. Both anionic and nonionic surfactants can be present as individual compounds, as mixtures with their own kind or as combinations of anionic and nonionic surfactants.

Suitable anionic surfactants are for example:

- sulfated aliphatic alcohols whose alkyl chain has 8 to 18 carbon atoms, e.g. sulfated lauryl alcohol;
- sulfated unsaturated fatty acids or fatty acid lower alkyl esters which have 8 to 20 carbon atoms in the fatty radical, for example ricinoleic acid, or oils containing such fatty acids, for example castor oil;
- alkylarylsulfonates having one or two straight-chain or branched alkyl chains having in total at least 6 carbon atoms, e.g. dodecylbenzenesulfonates, dibutylnaphthalenesulfonates or 3,7-diisobutylnaphthalenesulfonates;
- sulfonated 1-benzyl-2-alkylbenzimidazoles having 8 to 22 carbon atoms in the alkyl radical;
- sulfonates of polycarboxylic acid esters, for example dioctylsulfosuccinates or sulfosuccinamides;
- the "soap" alkali metal, ammonium or amine salts of fatty acids having 10 to 20 carbon atoms, for example rosin salts;
- esters of polyalcohols, in particular monoglycerides or diglycerides of fatty acids having 12 to 18 carbon atoms, for example monoglycerides of lauric, stearic or oleic acid, and
- acid esters formed from organic dicarboxylic acids, for example maleic acid, malonic acid or sulfosuccinic acid, but preferably inorganic polybasic acids, for example o-phosphoric acid or in particular sulfuric acid, and products of addition of 1 to 60, preferably 2 to 30, moles of ethylene oxide and/or propylene oxide onto fatty amines, fatty amides, fatty acids or fatty alcohols having 8 to 22 carbon atoms each, onto alkyl phenols having 4 to 16 carbon atoms in the alkyl chain, o-phenylphenol, benzylphenol or onto trihydric to hexahydric alkanols having 3 to 6 carbon atoms.

The acid radical of these anionic surfactants is in general present in the form of a salt, i.e. as an alkali metal, ammonium or amine salt. Examples of these salts are lithium, sodium, potassium, ammonium, trimethylamine, ethanolamine, diethanolamine or triethanolamine salts.

Anionic surfactants which are highly suitable for use as foam-forming agents are (1) acid esters, or salts thereof, of a polyadduct of 2 to 15 moles of ethylene oxide on 1 mole of fatty alcohol having 8 to 22 carbon atoms or on 1 mole of alkylphenol having 4 to 12 carbon atoms in the alkyl radical;

(2) alkylsulfates whose alkyl chain contains 8 to 20 carbon atoms, for example laurylsulfate;

(3) alkylphenylsulfonates having 8 to 18 carbon atoms in the alkyl radical; or (4) dialkylnaphthalenesulfonates having 3 to 5 carbon atoms per alkyl radical.

Components (1) to (4) can be used alone or as mixtures with one another as foam-forming agents.

The nonionic surfactant is advantageously a nonionic alkylene oxide addition product of 1 to 100 moles of alkylene oxide, for example ethylene oxide and/or propylene oxide, on 1 mole of an aliphatic monoalcohol having at least 4 carbon atoms, of a 3- to 6-hydric aliphatic alcohol, of a phenol which can be substituted by alkyl or phenyl, or of a fatty acid having 8 to 22 carbon atoms.

Nonionic surfactants are for example:

fatty alcohols having 8 to 22 carbon atoms, in particular cetyl alcohol;

addition products of preferably 2 to 80 moles of alkylene oxide, in particular ethylene oxide, it being possible for individual ethylene oxide units to be replaced by substituted expoxides, such as styrene oxide and/or propylene oxide, on higher unsaturated or saturated monoalcohols, fatty acids, fatty amines or fatty amides having 8 to 22 carbon atoms or on phenylphenol or alkylphenols whose alkyl radicals have at least 4 carbon atoms;

alkylene oxide, in particular ethylene oxide and/or propylene oxide, condensation products (block polymers);

reaction products of a fatty acid having 8 to 22 carbon atoms and a primary or secondary amine having at least one hydroxy lower alkyl or lower alkoxy lower alkyl group, or alkylene oxide addition products of these hydroxyalkyl-containing reaction products, the reaction being effected in such a way that the molecular mixing ratio between hydroxyalkylamine and fatty acid can be 1:1 and greater than 1, for example 1:1 to 2:1, and addition products of propylene oxide on a trihydric to hexahydric aliphatic alcohol of 3 to 6 carbon atoms, for example glycerol or pentaerythritol, the polypropylene oxide adducts having an average molecular weight of 250 to 1800, preferably 400 to 900.

Nonionic surfactants which are highly suitable for use as foam-forming agents are:

(5) addition products of 2 to 15 moles of ethylene oxide on 1 mole of an aliphatic monoalcohol or fatty acid having 8 to 22 carbon atoms each or on 1 mole of alkylphenol having a total of 4 to 12 carbon atoms in the alkyl moiety, in particular the addition product of 2 moles of ethylene oxide on 1 mole of cetyl alcohol;

(6) fatty acid alkanolamides having 8 to 22 carbon atoms in the fatty acid radical and 2 to 6 carbon atoms in the alkanol moiety.

Further highly suitable nonionic surfactants are block polymers of the formula $$R'-O-(CH_2CH_2-O)_{n1}-(\underset{Z_1}{CH}-\underset{Z_2}{CH}-O)_y-(CH_2CH_2O)_{n2}-H \quad (4)$$

or of the formula $$R'-O-(\underset{Z_1}{CH}-\underset{Z_2}{CH}-O)_{y1}-(CH_2CH_2O)_x-(\underset{Z_1}{CH}-\underset{Z_2}{CH}-O)_{y2}-H \quad (5)$$

in which R' is hydrogen, alkyl or alkenyl having at most 22 carbon atoms, preferably 8 to 16 carbon atoms, o-phenylphenyl or alkylphenyl having 4 to 12 carbon atoms in the alkyl moiety, one of $Z_1$ and $Z_2$ is hydrogen and the other methyl, y is 1 to 75, preferably 3 to 50, and x is 1 to 30, and the total of $n_1+n_2$ is 3 to 50, preferably 3 to 30, and of $y_1+y_2$ is 2 to 30, preferably 4 to 20, and $n_2$ or $y_2$ can also be 0.

Preferred block polymers of the formula (4) are those in which R' is alkyl or alkenyl of 4 to 18, preferably 8 to 16, carbon atoms, y is 1 to 30, preferably 3 to 15, $n_1$ is 3 to 30 and $n_2$ is 0.

Particularly advantageous block polymers are fatty alcohol polyglycol coethers, in particular addition products of 3 to 30 moles of ethylene oxide and 3 to 30 moles of propylene oxide on aliphatic monoalcohols of 8 to 22 carbon atoms, preferably alkanols of 8 to 16 carbon atoms.

These block polymers are advantageously based on 10 to 50 pereent by weight of units derived from ethylene oxide and 50 to 90 percent by weight of units derived from propylene oxide and have a molecular weight of 300 to 7000, in particular 350 to 3500.

The nonionic surfactants used can further be siloxane-oxyalkylene copolymers. These polymers are reaction products of halogen-substituted organopolysiloxanes and alkali metal salts of polyoxyalkylene, for example polyethylene glycol or polypropylene glycol. Such compounds are described for example in European Patent Specification No. 30,919 or 49,832.

Prefered block polymers and siloxane-oxyalkylene copolymers which are used as foam-forming agents or foam moderators advantageously have a cloud point of 15° to 70° C., preferably 25° to 50° C.. The cloud point is determined in accordance with for example DIN 53,917.

The foam-forming agents used according to the invention are preferably used in the form of mixtures of the abovementioned anionic and/or nonionic surfactants.

In addition to the anionic and/or nonionic surfactants mentioned, the foam-forming mixtures can contain cation-active quaternary ammonium salts. The latter can be prepared for example by reacting aliphatic fatty amines with alkyl or alkenyl radicals having 8 to 24 carbon atoms, for example dodecylamine, hexadecylamine, heptadecylamine, octadecylamine, tallow fatty amine, behenylamine or oleylamine or diamines and triamines, for example dodecylpropylenediamine, octadecylethylenediamine and octadecyldiethylenetriamine, with 1 to 35 equivalents of an alkylene oxide, for example propylene oxide or in particular ethylene oxide or a mixture of propylene oxide and ethylene oxide and facultatively additionally with 1 to 2 equivalents of styrene oxide and by subsequent reaction with customary quaternizing agents, for example methyl, ethyl or benzyl halide, diethyl sulfate and in particular dimethyl sulfate, halohydrins, halocarboxamides, for example chloroacetamide.

It is also possible to use mixtures of these cation-active assistants.

Cation-active assistants of particularly good utility are quaternization products of dimethyl sulfate, diethyl sulfate or $C_1$–$C_2$-alkyl halides, for example methyl chloride or iodide, with addition products of 2 to 35 moles of ethylene oxide with or without an additional 1 mole of styrene oxide on alkylamines or alkenylamines having 12 to 24 carbon atoms or mixtures thereof.

Preferred mixtures of foam-forming agents are for example combinations of components (1), (2), (3), (4), (5) and (6) and in particular those of (A) alkylsulfonates having 8 to 20 carbon atoms and fatty alcohols having 12 to 22 carbon atoms or addition products of 1 to 4 moles of ethylene oxide on these fatty alcohols, (B) addition products of 2 to 12 moles of ethylene oxide on 1 mole of alkylphenol having 4 to 12 carbon atoms in the alkyl moiety, sodium salts of sulfuric acid esters or fatty alcohol/ethylene oxide adducts having 10 to 22 carbon atoms in the alcohol moiety and 2 to 4 ethylene oxide units, and fatty acid diethanolamides having 8 to 18 carbon atoms in the fatty acid radical, (C) addition products of 1 to 15 moles of ethylene oxide on 1 mole of fatty alcohol having 12 to 22 carbon atoms and fatty acid diethanolamides having 8 to 18 carbon atoms in the fatty acid radical, (D) sodium salts of sulfuric acid esters of fatty alcohol/ethylene oxide adducts having 10 to 22 carbon atoms in the alcohol moiety and 2 to 4 ethylene oxide units, fatty acid diethanolamides having 8 to 18 carbon atoms in the fatty acid radical and if desired addition products of 1 to 4 moles of ethylene oxide on $C_{12}$–$C_{22}$-fatty alcohols, (E) sodium salts of sulfuric acid esters of fatty alcohol/ethylene oxide adducts having 10 to 22 carbon atoms in the alcohol moiety and 2 to 4 ethylene oxide units, fatty acid diethanolamides having 8 to 18 carbon atoms in the fatty acid radical, alkylbenzenesulfonates having 8 to 12 carbon atoms in the alkyl moiety and if desired additionally the disodium salt of 1-benzyl-2-$C_{17}$–$C_{18}$-alkylbenzimidazoldisulfonic acid, (F) a sulfuric acid ester, or salts thereof, of an addition product of 2 to 15 moles of ethylene oxide on 1 mole of aliphatic monoalcohol having 8 to 18 carbon atoms or in particular on 1 mole of an alkylphenol having 4 to 12 carbon atoms in the alkyl radical, and an addition product of 3 to 10 moles of ethylene oxide and 3 to 10 moles of propylene oxide on 1 mole of aliphatic monoalcohol having 8 to 16 carbon atoms, or (G) a sulfuric acid ester, or salts thereof (in particular diethanolamine salts), of an addition product of 2 to 15 moles of ethylene oxide on 1 mole of an aliphatic monoalcohol having 8 to 18 carbon atoms, a fatty acid diethanolamide having 8 to 18 carbon atoms in the fatty acid radical, a dialkylnaphthalenesulfonate having 3 to 5 carbon atoms per alkyl radical with or without an addition product of 2 to 80 moles of ethylene oxide on 1 mole of fatty alcohol having 12 to 22 carbon atoms and/or an addition product, quaternized with dimethyl sulfate, of 1 mole of styrene oxide and 10 to 30 moles of ethylene oxide on 1 mole of fatty amine having 12 to 22 carbon atoms.

The foam-forming mixtures can be prepared by simply stirring the components with water. If desired, the foam-forming agents can be added to the treatment liquors in the form of one or more mixtures. These individual mixtures can also serve as foam moderators, foam stabilizers or wetting agents.

The dosage levels in which the foam-forming agents, preferably in the form of mixtures, are added to the preparations vary with the printing or dyeing method from 5 to 200 g, preferably from 10 to 100 g, per liter of the treatment preparation to be foamed.

The dyes used in the process according to the invention are the reactive dyes customarily used for dyeing or printing cellulose textile materials.

Reactive dyes are to be understood as meaning the usual dyes which enter a chemical bond with the cellulose, for example the "Reactive Dyes" listed in the Colour Index in volume 3 (3rd edition, 1971) on pages 3391–3560 and in volume 6 (revised 3rd edition, 1975) on pages 6268–6345.

The amount of dye generally depends on the desired depth of shade and advantageously varies from 1 to 400 g per liter of preparation, advantageously from 5 to 300 and preferably from 10 to 200 g/l of preparation (print paste or dyeing liquor).

To fix the reactive dyes, the preparations generally contain alkalis. Suitable alkaline compounds are for example sodium carbonate, sodium hydroxide, disodium phosphate, trisodium phosphate, borax, aqueous ammonia or alkali donors, e.g. sodium trichloroacetate or sodium formate. The alkali used can also be a mixture of sodium silicate and a 25% aqueous sodium carbonate solution.

The pH value of alkali-containing preparations is in general 7.5 to 13.2, preferably 8.5 to 11.5.

The process according to the invention is suitable in particular for printing textiles which consist of or contain cellulose.

Suitable cellulose material is regenerated or in particular natural cellulose, e.g. viscose staple, viscose filament, cellulose acetate, hemp, linen, jute or preferably cotton, as well as fibre blends, for example those of polyamide/cotton or in particular polyester/cotton, the polyester portion being simultaneously printable or dyeable with disperse dyes.

The textile material is applicable in any form, for example as yarn, hank, woven or knitted fabric, felt, preferably in the form of textile sheet structures such as woven or knitted fabrics which consist wholly or partly of natural, regenerated or modified cellulose.

The print pastes or dye liquors to be foamed are advantageously prepared by dissolving the dye and by adding the betainelike quaternary ammonium salts, the acrylamide polymers, the foam-forming agents and alkali. Depending on the dye used, the print pastes or dye liquors can contain further customary additives, for example electrolytes, glycerol, urea, oxidants, for example nitrobenzenesulfonate or sodium chlorate, sequestrants or, depending on the print paste or dye liquor, wetting agents as well. The addition of thickeners is not necessary.

The foams can be produced on commercially customary foaming apparatus, if desired in a continuous manner.

According to the invention, foams having a good utility have a weight per liter of 65 to 350 g, preferably 150 to 250 g.

The foams used according to the invention are thick, dense and stable, i.e. they last and they are usable for a long time. Preferably the foams used according to the invention have a drop outflow time (DOT) of 30 minutes to 100 hours, preferably 1 to 50 hours. The bubble diameter in the foams is about 1 to 150μ.

The foams can be applied uniformly to the fibre materials by various application techniques. Examples of some possibilities are: sucking in, roll coating (on one or both sides), blowing in, pressing in or printing. The foam paste can be applied using the machines customary in textile printing, for example screen or roller printing machines. Advantageously the foam is applied by means of a screen printing machine, preferably in an enclosed system. Systems of this type are described for example in German Offenlegungsschriften Nos. 3,034,802 and 3,034,803.

The foams are advantageously applied at a temperature of 10° to 90° C., in general at room temperature, i.e. at about 15° to 30° C. Based on the treated fabric, the foam addon is in general 10 to 120, in particular 15 to 50, per cent by weight.

The foam can be applied out of a foam vessel, preferably with an adjustable doctor blade, via an application roll to the front face of the fabric. On contact with the fabric the foam is immediately dewatered. If desired, the foam application can be repeated on the reverse side of the fabric. In this case, intermediate drying between the application to the front face and the reverse face is not necessary. It is also possible to apply different print foams to the front and back of the textile.

Preferably the foam application according to the invention is effected by first foaming the treatment preparation in a suitable apparatus in an enclosed system, for example under superatmospheric pressure, and transporting the resulting foam by means of pipes to the application apparatus. The foam is then applied, preferably by means of a sieve or a sievelike support, to the textile sheet structure, whereupon the foam is sucked into the textile material by mechanical imprinting, impressing or knife-coating. The sieve or sievelike support used can be a perforated sheet of metal, a lattice, network, wire mesh, sieve drum or a screen.

In the course of the procedures mentioned, the foam structure is destroyed, with bursting of the foam bubbles, whereupon the foam becomes dewatered and the textile material is uniformly wetted.

After the foam has been applied and dewatered, the printed or dyed textile material is preferably dried and then subjected to a heat treatment process in order to complete the dyeings (more specifically, to fix the dye).

The heat treatment can be carried out as a hot dwell process, as a thermosoling process or preferably as a steaming process.

In the steaming process, the textile materials printed with the coloured foam are subjected to a treatment in a steamer with what may be superheated steam, advantageously at a temperature of 98° tto 210° C., preferably 100° to 180° C. and ideally 100° to 120° C.

In the hot dwell process, the material is dwelled in the moist state, preferably at temperatures of 85° to 102° C., for example for 5 to 120 minutes. In this process, the printed material can be preheated to 85° to 102° C. by means of an infrared treatment. Preferably the dwell temperature is 95° to 100° C.

Finishing of the prints or dyeings by means of the so-called thermosoling process can take place at a temperature of for example 100° to 210° C. with or without prior intermediate drying. Preferably thermosoling takes place at a temperature of 120° to 210° C., preferably 140° to 180° C., and after an intermediate drying at 80° to 120° C. of the printed material. Depending on the temperature, thermosoling can take 2 seconds to 5 minutes, preferably 30 seconds to 4 minutes.

After the dyeing process the dyed cellulose-containing textile material can be washed off in a conventional manner in order to remove unfixed dye. To this end the substrate is treated for example at between 40° C. and the boil in a solution which contains soap or synthetic washing agent. This can be followed by a treatment with a fixing agent in order to improve the wet fastness properties.

The process according to the invention produces level and strong coloured prints which have improved crispness, a good handle and excellent appearance. Furthermore, the allround fastness properties of the dyed material, for example light fastness, crock fastness and wet fastness properties, are not adversely affected by the use of the defined betainelike quaternary ammonium salts and acrylamide polymers.

In particular, by means of the foam application according to the invention it is possible to obtain coloured prints wit reactive dyes on cellulose-containing textiles without using customary thickeners, e.g. alginates, cellulose derivativss, starch ethers or bean flour ethers such as carob bean flour ether, which are generally used in large amounts. Using the betainelike quaternary ammonium salts of the type defined together with the acrylamide polymers gives excellent foam stability which lasts for at least 24 hours.

In the following Methods, Preparation Examples and Application Examples, the parts and percentages are by weight, unless otherwise stated.

The amounts are based in the case of the dyes on commercially available, i.e. diluted, material and in the case of the assistants on pure substance. The five-digit Colour Index (C.I.) numbers relate to the 3rd edition of the Colour Index.

Methods of preparation

Method 1: A solution of 22.5 g of acrylamide, 2.5 g of an addition product of 52 mol of propylene oxide on 1 mol of glycerol and 0.04 g of potassium peroxodisulfate in 200 g of water is heated to 50° C. with stirring and passing over of nitrogen and is maintained at that temperature for 3 hours. A solution of 0.03 g of potassium peroxodisulfate in 40 g of water is then added dropwise in the course of 60 minutes, and the very viscous solution is diluted by adding 300 ml of water in the course of 30 minutes. The reaction mixture is then maintained at 50° C. for 5 hours, is subsequently treated with 0.6 g of hydroquinone monomethyl ether and 0.12 g of sodium azide, and is cooled down to room temperature with stirring. This gives 565 g of a gel having a polymer content of 4.4%. This gel has a viscosity, measured at 25° C., of 112,957 mPas.

Method 2: A solution of 71.25 g of acrylamide, 3.75 g of an adduct of propylene oxide and glycerol having an average molecular weight of 4200 and 0.09 g of potassium peroxodisulfate in 600 g of water is introduced first and heated to 50° C. with stirring and passing over of nitrogen and then maintained at 50° C. for 3 hours. The viscosity of the solution gradually increases. A solution of 0.06 g of potassium peroxodisulfate in 120 g of water is added dropwise in the course of 60 minutes. About 10 minutes after the start of the dropwise addition the viscosity of the solution becomes so high that 600 g of water must be added in the course of the next 20 minutes. On completion of the dropwise addition of potassium peroxodisulfate solution, the increasingly more viscous solution is maintained at 50° C. for a further 5 hours, being diluted with an additional 400 g of water added a little at a time. 1.7 g of hydroquinone monomethyl ether are added, and the mixture is cooled down with stirring to room temperature to give 1794 g of a free-flowing gel having a polymer content of 4.3%. This gel has a viscosity, measured at 25° C., of 64,202 mPas.

Method 3: A solution of 71.25 g of acrylamide, 3.75 g of an adduct of propylene oxide and pentaerythritol having an average molecular weight of 3350 and 0.09 g of potassium peroxodisulfate in 600 g of water is heated to 50° C. with stirring and passing over of nitrogen and is maintained at 50° C. for 3 hours. The viscosity of the solution gradually increases. A solution of 0.06 g of potassium peroxodisulfate in 120 g of water is then added dropwise in the course of 60 minutes. About 30 minutes after completion of the dropwise addition, the viscosity of the solution increases. For that reason 600 g of water are added during the next 20 minutes. The increasingly more viscous solution is then maintained at 50° C. for a further 4 hours and is thereafter diluted with an additional 400 g of water, 3.4 g of triethanolamine are added, and the solution is cooled down to room temperature with stirring to give 1793 g of a still fluent gel having a solids content of 4.0%. This gel has a viscosity, measured at 25° C., of 75,300 mPas.

Method 4: A solution of 17.8 g of acrylamide, 0.94 g of an addition product of 70 mol of propylene oxide and 6 mol of ethylene oxide on 1 mol of glycerol and 0.025 g of potassium peroxodisulfate in 250 g of water is heated to 50° C. with stirring and passing over of nitrogen and is maintained at that temperature for 3 hours. The temperature of the solution is then raised to 60°-63° C. in the course of 20 minutes until the viscosity increases significantly, and thereafter is cooled down to 55° C. The increasingly more viscous solution is maintained at 55° C. for 5 hours. A solution of 0.45 g of chloroacetamide and 0.45 g of hydroquinone monomethyl ether in 177 g of water is then added to the viscous solution to give 446 g of a gel having a graft polymer content of 4.2%. This gel has a viscosity, measured at 25° C., of 96,750 mPas.

Method 5: Method 4 is repeated, except that the stated addition product is replaced by a further addition product of 53 mol of propylene oxide and 1 mol of trimethylolpropane, affording 446 g of a gel having a graft polymer content of 4.2%. This gel has a viscosity, measured at 25° C., of 19,500 mPas.

Method 6: A solution of 17.24 g of acrylamide, 4.31 g of an addition product of 70 mol of propylene oxide and 1 mol of glycerol and 0.035 g of potassium peroxodisulfate in 200 g of water is heated to 50° C. with stirring and passing over of nitrogen and is maintained at that temperature for 4 hours. The increasingly more viscous solution is then heated to 55° C. for 5 hours. A solution of 0.4 g of chloroacetamide and 0.4 g of hydroquinone monomethyl ether in 291 g of water is then added to the gel to give 513 g of a gel having a polymer content of 4.2%. This gel has a viscosity, measured at 25° C., of 25,750 mPas.

Method 7: A mixture of 15.1 g of acrylamide, 6.5 g of an addition product of 70 mol of propylene oxide on 1 mol of glycerol and 0.025 g of potassium peroxodisulfate in 200 g of water is heated to 50° C. with stirring and passing over of nitrogen and is maintained at that temperature for 3 hours. The increasingly more viscous solution is then heated at 55° C. for 5 hours. A solution of 0.4 g of chloroacetamide and 0.4 g of hydroquinone monomethyl ether in 291 g of water is then added to the gel to give 512 g of a gel having a polymer content of 4.2%. This gel has a viscosity, measured at 25° C., of 16,300 mPas.

Method 8: A mixture of 13 g of acrylamide, 8.7 g of an addition product of 70 mol of propylene oxide on 1 mol of glycerol and 0.015 g of potassium peroxodisulfate in 150 g of water is heated to 50° C. with stirring and passing over of nitrogen and is maintained at that temperature for 4 hours. The increasingly more viscous solution is then heated at 65° C. for 2 hours and at 60° C. for a further 3 hours. A solution of 0.4 g of chloroacetamide and 0.4 g of hydroquinone monomethyl ether in 347 g of water is then added to the gel to give 519 g of a gel having a polymer content of 4.2%. This gel has a viscosity, measured at 25° C., of 15,582 mPas.

PREPARATION EXAMPLES

Example 1

488 g of the addition product of 50 mol of ethylene oxide on 1 mol of stearyl alcohol (molecular weight 2440) and 19.6 g of maleic anhydride are melted, and 0.01 ml of tri-n-butylamine is adeed. The reaction mixture is then stirred at 80° C. for 2 hours. 20 g of epichlorohydrin is then added dropwise, whereupon-the mixture is stirred at 80° C. for a further 1½ hours. Excess epichlorohydrin is then removed under a water jet vacuum, and the reaction product is cooled down to room temperature. 100 ml of water are then added, followed by the dropwise addition of 18 g of sodium pyrosulfite in 30 ml of water. This mixture is heated to 80° C. and is maintained at that temperature for 1 hour, 34.5 g of N-(dimethylaminopropyl) methacrylamide are then added dropwise, and the dropping funnel is rinsed out with 10 ml of water. The reaction mixture is maintained at 80° C. for 2 hours, during which a viscous resin is formed. 2180 g of water are added, which is followed by stirring at 50° C. for 24 hours to give a clear highly viscous solution having a solids content of 20%. Yield: 2900 g, reduced viscosity: 0.09 dl/g.

Using in place of the addition product of 50 mol of ethylene oxide on stearyl alcohol an addition product of 8 mol or 15 mol of ethylene oxide on 1 mol of stearyl alcohol and instead of N-(dimethylaminopropyl)-methacrylamide N-(dimethylaminopropyl)-acrylamide gives two further betainelike quaternary ammonium salts which are based on acrylamide derivatives.

Example 2

45.8 g of the addition product of 15 mol of ethylene oxide on 1 mol of a linear $C_{16}$–$C_{18}$-alcohol (Alfol) (molecular weight 917.3), 4.9 g of maleic anhydride and 0.01 ml of tri-n-butylamine are heated to 70° C., turning into a melt which is subsequently maintained at 70° C. for 1½ hours. 5.0 g of epichlorohydrin are then added dropwise, and the mixture is stirred at 70° C. for a further 3 hours. Excess epichlorohydrin is then removed under a water jet vacuum. 8.5 g of N-(dimethylaminopropyl)-methacrylamide are then added dropwise and stirred in at 70° C. for 30 minutes. The temperature is reduced to 60° C., the resin formed is dissolved in 213 g of water, and subsequently a solution of 5.2 g of sodium pyrosulfite in 64.5 g of water is added dropwise. This is followed by 30 minutes of stirring, cooling down to room temperature, addition of 0.2 g of 2,2'-azobis(2-amidinopropane) hydrochloride, heating back up again to 60° C. and maintaining at that temperature for 1 hour. The result obtained is 386.5 g of a clear yellow solution having a solids content of 20.5%. Reduced viscosity: 0.04 dl/g.

APPLICATION EXAMPLES

Example 1

A print paste is prepared, containing in 1 liter of water the following additives: 90 g of a dye of the formula

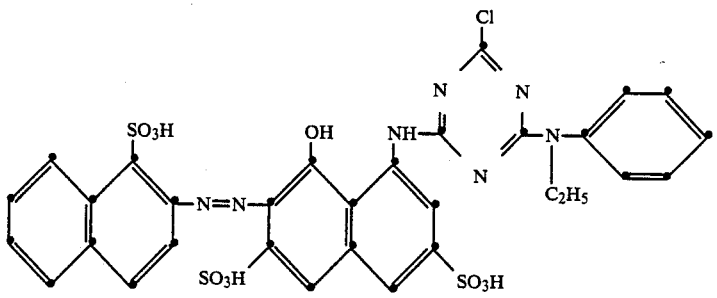

(11)

200 g of an aqueous mixture which contains 30 g of an addition product of 2 mol of ethylene oxide on 1 mol of cetyl alcohol and 0.1 g of sodium laurylsulfate, 20 g of a graft polymer prepared in accordance with Method 2, 5 g of the 20% quaternary ammonium salt prepared in accordance with Example 1, 10 g of the sodium salt of m-nitrobenzenesulfonic acid, 100 g of a 25% aqueous sodium carbonate solution and 100 g of urea.

The print paste is then foamed in an enclosed system by means of a foam-producing apparatus. The foam has a weight per liter of 192 g and a drop outflow time of over 48 hours.

This foam is forced through pipes and a screen onto a cotton fabric under a pressure of 2.5 bar. The printed fabric is then dried, steamed at 102° C. for 8 minutes, and then as usual soaped off and dried.

The result obtained is a strong, level and crisp red print having an excellent handle and good allround fastness properties.

Similar satisfactory prints are obtained when using in place of the graft polymer prepared in accordance with Method 2 the same amounts of the graft polymers prepared in accordance with Methods 1 and 3 to 8 and of polyacrylamide in the form of a 4% aqueous solution having a viscosity of 28,000 cps, measured at 25° C.

Example 2

A print paste is prepared, containing in 1 liter of water the following additives:

75 g of a dye of the formula

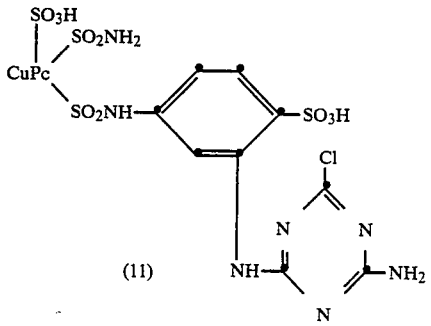

(12)

5 g of a dye of the formula

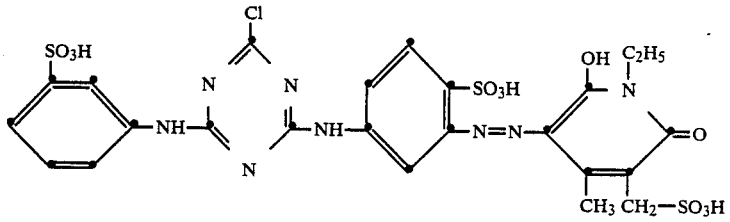

(13)

200 g of an aqueous mixture which contains 30.0 g of an addition product of 2 mol of ethylene oxide on 1 mol of cetyl alcohol and 0.1 g of sodium laurylsulfate, 20 g of the graft polymer prepared in accordance with Method 2, 10 g of the sodium salt of m-nitrobenzenesulfonic acid, 5 g of the 20% quaternary ammonium salt prepared in accordance with Example 1, 100 g of a 25% aqueous sodium carbonate solution and 100 g of urea.

The print paste is foamed in an enclosed system by means of a foam-producing apparatus. The foam has a weight per liter of 175 g. Drop outflow time: 48 hours.

This foam is forced through pipes and a screen onto a cotton fabric under a pressure of 2.5 bar. The printed fabric is then dried, steamed at 101° C. for 8 minutes, and then as usual rinsed and dried again.

The result obtained is a level brilliant green print having good fastness properties.

Example 3

A print paste is prepared, containing in 1 liter of water the following additives:

100 g of a dye of the formula

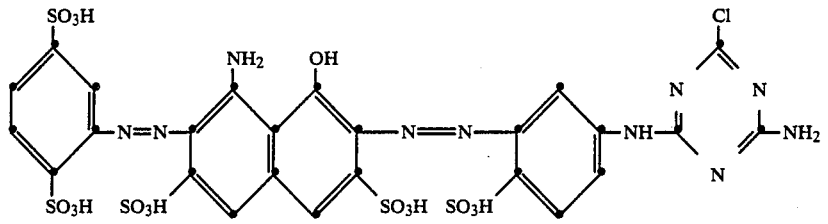

(14)

10 g of a dye of the formula (15)

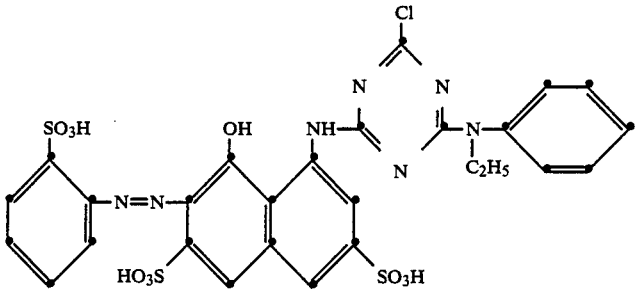

(15)

5 g of the 20% quaternary ammonium salt prepared in accordance with Example 1, 200 g of an aqueous mixture which contains 30 g of an addition product of 2 mol of ethylene oxide on 1 mol of cetyl alcohol and 0.1 g of sodium laurylsulfate, 20 g of the graft polymer prepared in accordance with Method 2, 10 g of the sodium salt of m-nitrobenzenesulfonic acid, 100 g of a 25% aqueous sodium carbonate solution and 100 g of urea.

The print paste is then foamed in an enclosed system by means of a foam-producing apparatus. The foam has a weight per liter of 238 g. Drop outflow time: 50 hours.

This foam is forced through pipes and a screen onto a cotton fabric under a pressure of 2.5 bar. The printed fbbric is then dried, steamed at 101° C. for 8 minutes, and then as usual soaped off and dried again.

The result obtained is a strong, level and crisp black print having an excellent handle and good allround fastness properties.

EXAMPLE 4

Two separate print pastes are prepared, each containing in 1 liter of water the following additives:

Print paste (A)

66 g of the yellow dye of the formula (13)

150 g of an aqueous mixture which contains 30 g of an addition product of 2 mol of ethylene oxide on 1 mol of cetyl alcohol and 0.1 g of sodium laurylsulfate, 50 g of the graft polymer prepared in accordance with Method 2, 5 g of the 20% quaternary ammonium salt prepared in accordance with Example 1, 10 g of the sodium salt of m-nitrobenzenesulfonic acid, 100 g of a 25% sodium carbonate solution and 100 g of urea.

Print paste (B)

60 g of the blue dye of the formula

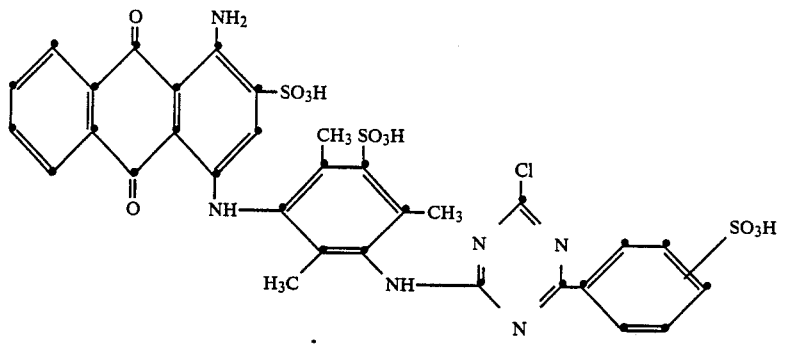

(16)

150 g of an aqueous mixture which contains 30 g of an addition product of 2 mol of ethylene oxide on 1 mol of cetyl alcohol and 0.1 g of sodium laurylsulfate, 50 g of the graft polymer prepared in accordance with Method 2, 5 g of the 20% quaternary ammonium salt prepared in accordance with Example 1, 10 g of the sodium salt of m-nitrobenzenesulfonic acid, 100 g of a 25% sodium carbonate solution and 100 g of urea.

The two print pastes are then separately foamed in an enclosed system by means of a foam-producing apparatus. The foam of print paste (A) has a weight per liter of 130 g and a drop outflow time (DOT) of 48 hours. In the case of print paste (B), the foam has a weight per liter of 115 g and the DOT is 48 hours.

On a duplex system the two foams are forced through an appropriate screen onto a cotton fabric under a pressure of 2.5 bar, printed paste (A) being printed on the front and print paste (B) on the back of the same fabric. The duplex-printed fabric is then dried, steamed at 101° C. for 8 minutes, and then as usual soaped off and dried. The duplex print is also finished without intermediate drying.

The result obtained is a strong, level and crisp yellow and blue print having an excellent handle and good allround fast properties on both sides.

EXAMPLE 5

A print paste is prepared, containing in 1 liter of water the following additives: 150 g of a dye of the formula in 50% liquid form, 150 g of an aqueous mixture which contains 22.5 g of an addition product of 2 mol of ethylene oxide on 1 mol of cetyl alcohol and 0.11 g of sodium laurylsulfate, 20 g of the graft polymer prepared in accordance with Method 2, 3 g of the 20% quaternary ammonium salt prepared in accordance with Example 1, 10 g of the sodium salt of m-nitrobenzenesulfonic acid, 100 g of a 25% aqueous sodium carbonate solution and 100 g of urea.

The print patte is then foamed in an enclosed system by means of a foam-producing apparatus. The foam has a weight per liter of 192 g and a drop outflow time of over 48 hours.

This foam is forced through pipes and a screen onto a cotton fabric under a pressure of 2.5 bar. The printed fabric is then dried, steamed at 102° C. for 8 minutes, and then as usual soaped off and dried.

The result obtained is a strong, level and crisp brown print having an excellent handle and good allround fastness properties.

Similar satisfactory prints are obtained on using in place of sodium laurylsulfate 0.15 g of the adduct of 1 mol of 1-p-tert.-octylphenol and 8 mol of ethylene oxide or 0.18 g of sodium dodecylbenzenesulfonate or 0.2 g of cocodiethanolamide.

EXAMPLE 6

A print paste is prepared, containing in 1 liter of water the following additives: 400 g of a dye mixture of the dyes of the formulae (14), (17) and (18)

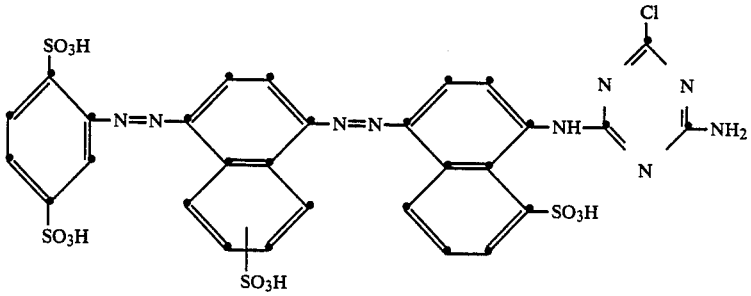

(17)

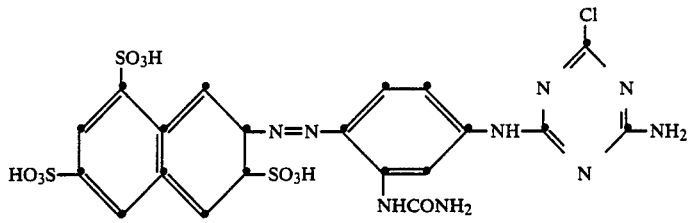

(18)

each in 40% liquid form and in a mixing ratio of 1:1:1, 150 g of an aqueous mixture which contains 22.5 g of an addition product of 2 mol of ethylene oxide on 1 mol of cetyl alcohol and 0.11 g of sodium lauryl-sulfate, 20 g of the graft polymer prepared in accordance with Method 2, 7.5 g of the quaternary ammonium salt prepared in accordance with Example 2, 10 g of the sodium salt of m-nitrobenzenesulfonic acid, 100 g of a 25% aqueous sodium carbonate solution and 100 g of urea.

The print paste is then foamed in an enclosed system by means of a foam-producing apparatus. The foam has a weight per liter of 192 g and a drop outflow time of over 48 hours.

This foam is forced through pipes and a screen onto a cotton fabric under a pressure of 2.5 bar. The printed fabric is then dried, steamed at 102° C. for 8 minutes, and then as usual soaped off and dried.

The result obtained is a strong, level and crisp black print having an excellent handle and good allround fastness properties.

20 g of the graft polymer prepared in accordance with Method 2, 3 g of the quaternary ammonium salt prepared in accordance with Example 1 and 50 g of urea.

The prnnt paste is then foamed in an enclosed system by means of a foam-producing apparatus. The foam has a weight per liter of 169 g and a drop outflow time of over 48 hours.

This foam is forced through pipes and a screen onto a cotton fabric under a pressure of 2.5 bar, followed by printin and drying. The printed fabric is then treated in a pad-mangle with a liquor which contains in a liter 100 g of sodium chloride 150 g of sodium carbonate 70 g of potassium carbonate and 50 g of 36°Bé NaOH (wet pick-up 80%) and is then steamed at 102° C. for 8 minutes, and as usual soaped off and dried.

The result obtained is a strong, level yellow print having an excellent handle and good allround fastness properties.

EXAMPLE 8

A print paste is prepared, containing in 1 liter the following additives 40 g of a dye of the formula

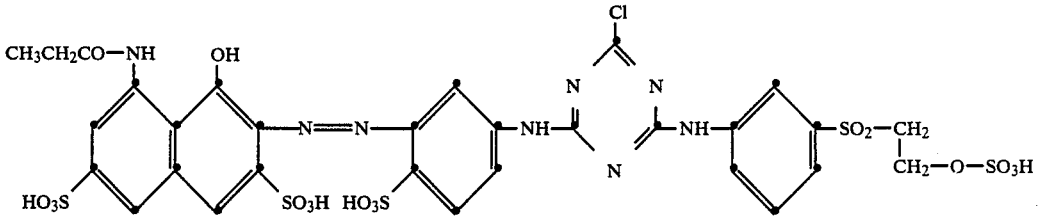

in 50% liquid form, 150 g of an aqueous mixture which contains 22.5 g of an addition product of 2 mol of ethylene oxide on 1 mol of cetyl alcohol and 0.11 g of sodium lauryl-

EXAMPLE 7

A print paste is prepared, containing in 1 liter of water the following additives:

240 g of a dye of the formula

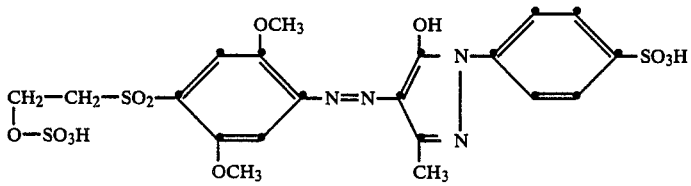

(19)

in 50% liquid form, 150 g of an aqueous mixture which contains 22.5 g of an addition product of 2 mol of ethylene oxide on 1 mol of cetyl alcohol and 0.11 g of sodium lauryl-sulfate, sulfate, 20 g of the graft polymer prepared in accordance with Method 2, 3 g of the quaternary ammqnium salt prepared in accordance with Example 1 and 50 g of urea.

The print paste is then foamed in an enclosed system by means of a foam-producing apparatus. The foam has a weight per liter of 200 g and a drop outflow time of over 48 hours.

This foam is forced through pipes and a screen onto a cotton fabric under a pressure of 2.5 bar. The printed fabric is then dried, steamed at 102° C. for 8 minutes and then as usual soaped off and dried.

The result obtained is a strong, level and crisp red print having an excellent handle and good allround fastness properties.

What is claimed is:

1. A quaternary ammonium salt which is obtainable by condensation of (A) a sulfonated asymmetric succinic acid diester which has as ester groups a halohydrin group and an etherified polyalkylene glycol group, with (B) a tertiary amine-substituted N-alkylamide of ethylenically unsaturated aliphatic monocarboxylic or dicarboxylic acid.

2. An ammonium salt according to claim 1, wherein the succinic acid diester (A) has an etherified polyalkylene glycol group which is derived from a monoetherified diol of the formula $$HO-(CH_2CH_2O)_mR \quad (1)$$

in which R is the radical of an aliphatic monoalcohol having 4 to 24 carbon atoms and m is 4 to 120.

3. An ammonium salt according to claim 2, wherein in formula (1) R is alkyl of 12 to 22 carbon atoms.

4. An ammonium salt according to claim 1, wherein component (B) is an N-substituted amide of the formula

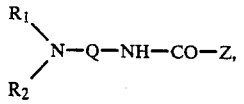

$$R_1R_2N-Q-NH-CO-Z, \quad (2)$$

in which $R_1$ and $R_2$ are each an alkyl radical having 1 to 5 carbon atoms,

Q is ethylene or propylene and

Z—CO— is the acid radical of an ethylenically unsaturated aliphatic monocarboxylic or dicarboxylic acid having at most 10 carbon atoms.

5. An ammonium salt according to claim 1, wherein (B) is an N-substituted amide of the formula

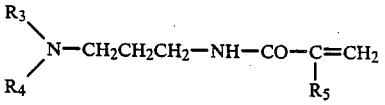

$$R_3R_4N-CH_2CH_2CH_2-NH-CO-C(R_5)=CH_2 \quad (3)$$

in which $R_3$ and $R_4$ are each methyl, ethyl or propyl and $R_5$ is hydrogen or methyl.

6. An ammonium salt according to claim 1, which is the condensation product of N-(dimethylaminopropyl)-methacrylamide and a sulfonated succinic acid diester which has been esterified with stearyl alcohol monoetherified polyethyleneglycol and epichlorohydrin.

* * * * *